US009756891B1

(12) United States Patent
McGhie et al.

(10) Patent No.: US 9,756,891 B1
(45) Date of Patent: Sep. 12, 2017

(54) APPARATUS FOR PROTECTING THE HEAD OF A PERSON FROM AN EXTERNAL FORCE

(71) Applicants: James Robb McGhie, Apple Valley, MN (US); Robb Inglis McGhie, Farmington, MN (US)

(72) Inventors: James Robb McGhie, Apple Valley, MN (US); Robb Inglis McGhie, Farmington, MN (US)

( * ) Notice: Subject to any disclaimer, the term of this patent is extended or adjusted under 35 U.S.C. 154(b) by 0 days.

(21) Appl. No.: 15/045,954

(22) Filed: Feb. 17, 2016

Related U.S. Application Data

(60) Provisional application No. 62/230,687, filed on Jun. 11, 2015.

(51) Int. Cl.

| | |
|---|---|
| ***A42B 3/10*** | (2006.01) |
| ***A42B 3/12*** | (2006.01) |
| ***A42B 3/14*** | (2006.01) |
| ***A42B 3/06*** | (2006.01) |

(52) U.S. Cl.
CPC ..... *A42B 3/121* (2013.01); *A42B 3/10* (2013.01); *A42B 3/12* (2013.01); *A42B 3/063* (2013.01); *A42B 3/128* (2013.01); *A42B 3/14* (2013.01)

(58) Field of Classification Search
CPC .... A42B 3/00; A42B 3/10; A42B 3/12; A42B 3/121; A42B 3/128; A42B 3/14; A42B 3/063; A42B 3/222
See application file for complete search history.

(56) References Cited

U.S. PATENT DOCUMENTS

| | | | | | |
|---|---|---|---|---|---|
| 2,759,186 | A | * | 8/1956 | Dye | A42B 3/121 2/413 |
| 3,599,239 | A | * | 8/1971 | Tatum | A42B 3/14 2/416 |
| 3,600,714 | A | | 8/1971 | Cade | |
| 3,668,704 | A | * | 6/1972 | Conroy | A42B 3/122 2/413 |
| 3,761,959 | A | * | 10/1973 | Dunning | A42B 3/122 137/223 |
| 3,818,508 | A | | 6/1974 | Lammers | |
| 3,872,511 | A | * | 3/1975 | Nichols | A42B 3/121 2/413 |
| 3,994,020 | A | * | 11/1976 | Villari | A42B 3/122 2/413 |
| 3,999,220 | A | * | 12/1976 | Keltner | A42B 3/065 2/23 |
| 4,282,610 | A | | 8/1981 | Steigerwald | |
| 5,204,998 | A | | 4/1993 | Liu | |
| 5,815,846 | A | * | 10/1998 | Calonge | A42B 3/121 2/413 |
| 5,915,819 | A | * | 6/1999 | Gooding | A42B 3/121 36/10 |

(Continued)

*Primary Examiner* — Khoa Huynh
*Assistant Examiner* — Jocelyn Wu
(74) *Attorney, Agent, or Firm* — Ted Masters

(57) ABSTRACT

Apparatus for protecting the head of a person from an external force includes an inner shell which fits over the head of the person and an outer shell which fits over the inner shell. A plurality of bags which contain a pressurized gas are disposed between the inner shell and the outer shell. When an external force is applied to the outer shell some of the bags distribute and partially absorb the external force thereby reducing the force experienced by the person.

3 Claims, 8 Drawing Sheets

(56) References Cited

U.S. PATENT DOCUMENTS

| | | | | |
|---|---|---|---|---|
| 5,916,664 | A * | 6/1999 | Rudy | A41D 31/0044 2/161.1 |
| 5,956,777 | A * | 9/1999 | Popovich | A42B 3/065 2/412 |
| 7,603,725 | B2 | 10/2009 | Harris | |
| 7,774,866 | B2 | 8/2010 | Ferrara | |
| 8,739,317 | B2 | 6/2014 | Abernethy | |
| 8,756,719 | B2 | 6/2014 | Veazie | |
| 8,844,066 | B1 | 9/2014 | Whitcomb | |
| 8,881,315 | B2 | 11/2014 | Desjardins | |
| 8,914,916 | B2 | 12/2014 | Castillo | |
| 8,927,088 | B2 | 1/2015 | Faden | |
| 2006/0059605 | A1* | 3/2006 | Ferrara | A42B 3/121 2/410 |
| 2012/0233745 | A1* | 9/2012 | Veazie | A42B 3/121 2/413 |
| 2013/0283507 | A1* | 10/2013 | Baty | A42B 3/14 2/416 |
| 2014/0068838 | A1* | 3/2014 | Beers | A61F 5/028 2/243.1 |
| 2014/0068841 | A1* | 3/2014 | Brown | A42B 3/121 2/413 |

* cited by examiner

Fig. 1
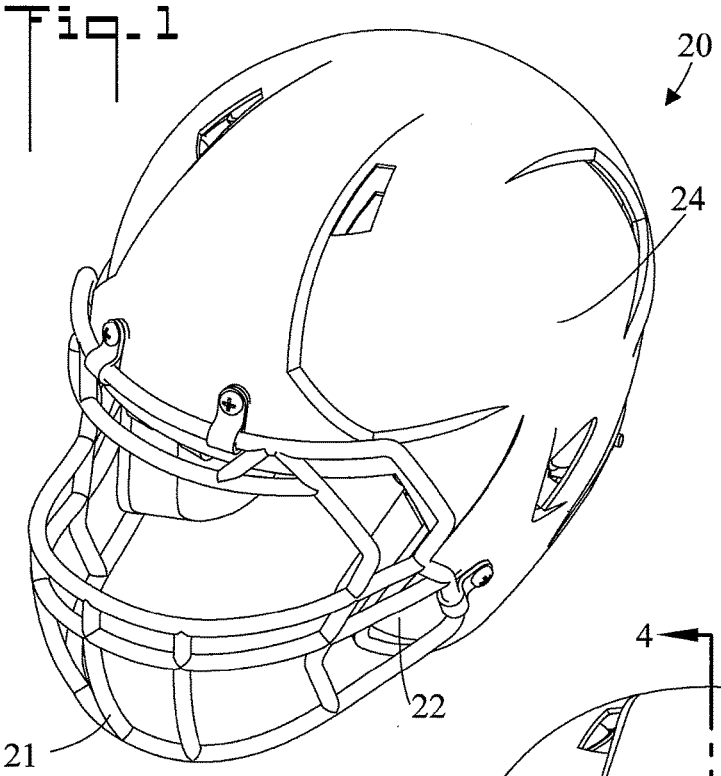
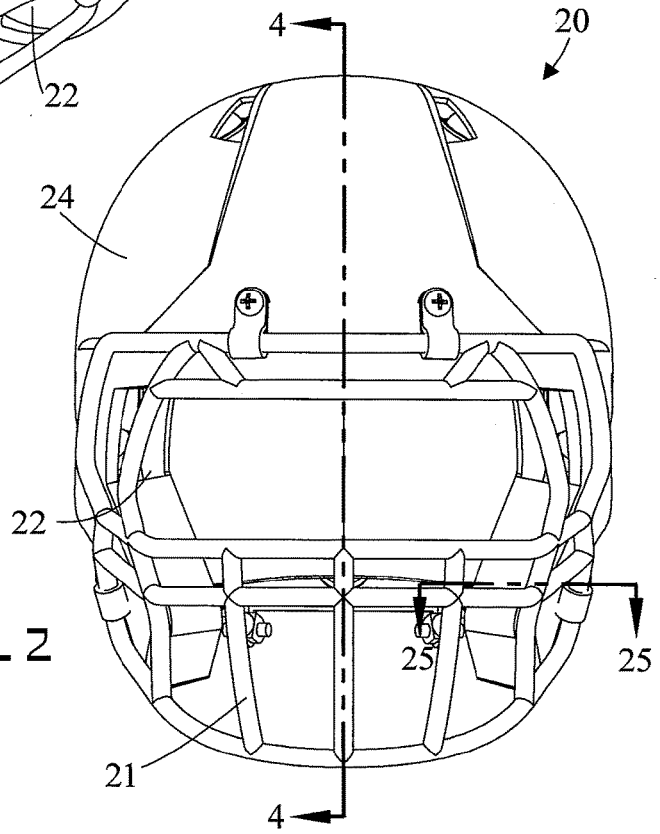
Fig. 2

20
24
64
64
36
21
26
34
22
34
38

Fig. 10
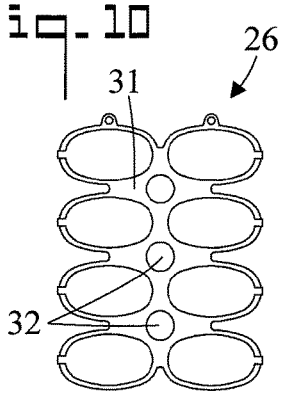
Fig. 11
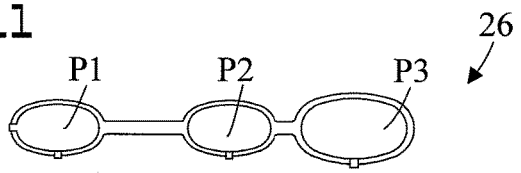
Fig. 12
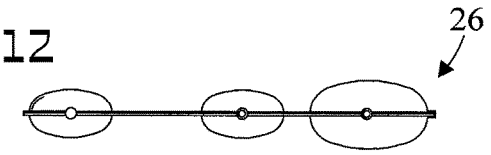
Fig. 13
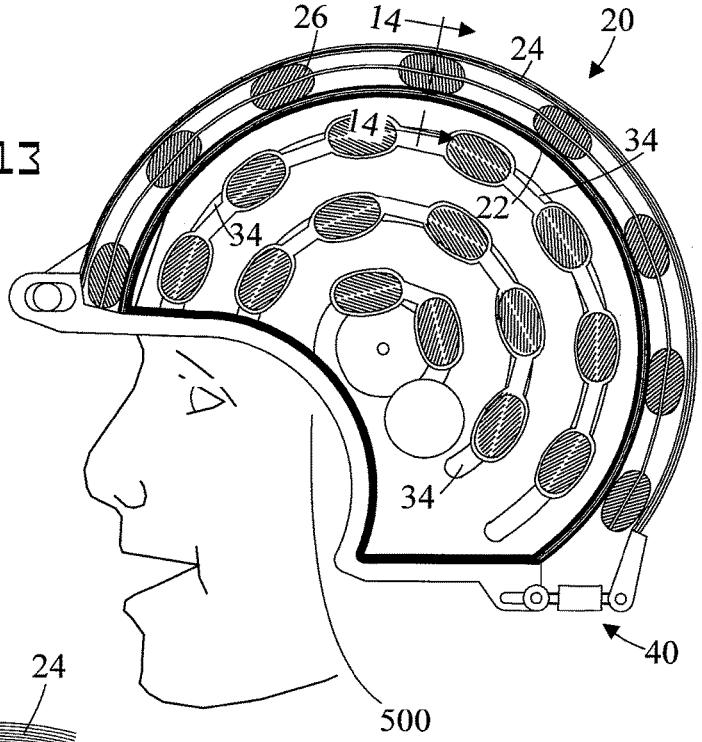
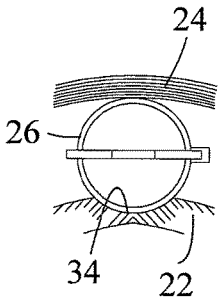
Fig. 14

Fig. 15
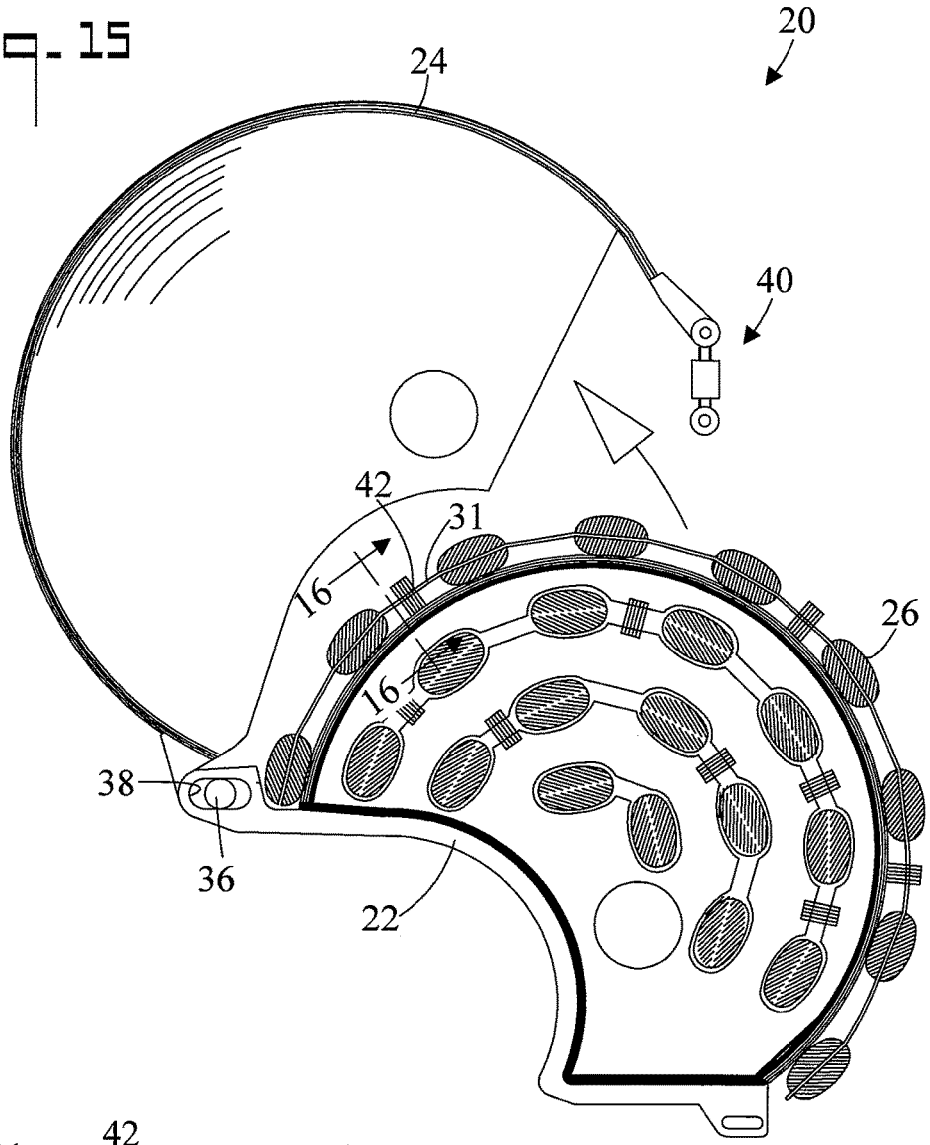
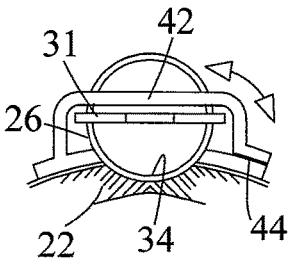
Fig. 16

APPARATUS FOR PROTECTING THE HEAD OF A PERSON FROM AN EXTERNAL FORCE

CROSS REFERENCE TO RELATED APPLICATION

This application claims the filing benefit under 35 U.S.C. §119(e) of U.S. Provisional Application No. 62/230,687, filed Jun. 11, 2015, which is hereby incorporated by reference.

TECHNICAL FIELD

The present invention pertains generally to injury prevention, and more particularly to apparatus which protects the head of a person by absorbing the energy of an impact from an external force. The invention includes an energy absorbing wrap of sealed bags (cushions) of pressurized gas which will reduce the force generated from impact loading. More particularly the bags will absorb energy and in the process reduce dangerously high impact forces.

BACKGROUND OF THE INVENTION

The heads of individuals can be subjected to dangerous impact loading in numerous professional and/or recreational activities. Typical activities include football, hockey, race cars, motorcycles, bicycles, construction, military, etc. Protection of the head and brain is critical when considering the impact that can occur in these activities. Various methods are utilized to mitigate head injuries. These generally consist of providing a helmet or other head covering which has a hard outer shell and some form of internal cushioning.

Existing helmet systems use a combination of foam and/or air (atmospheric based) shock absorbers to manage impact. The disadvantage of these systems is how efficiently they distribute the impact. For the most part, these systems do not absorb as much impact due to the fact that they are not predictably pressurized prior to the impact.

BRIEF SUMMARY OF THE INVENTION

The present invention is directed to headgear apparatus with an energy absorbing and distribution system. The present invention includes an energy absorbing wrap of bags of inert gas under pressure which will reduce the force generated from impact loading. The bags are disposed between an outer shell and an inner shell, and absorb a significant portion of the impact energy, thereby reducing the force to the head of the person (wearer). More particularly, the bags will absorb energy and in the process reduce dangerously high impact forces. An object of the invention is to provide safety protection and in particular minimize impact force to the head and neck of a wearer.

The invention as described herein is used in the context of football, but applications in other sports and recreational activities, construction, and the military are envisioned. Use in contact sports such as football has the additional benefit of cutting the impact force in half if both participants are wearing the apparatus (such as a helmet) and make contact. In a broader sense, the present invention is applicable to any areas where individuals are subjected to dangerous impact loading in their professional and/or recreational activities. Areas such as football, hockey, race cars, motorcycles etc. can benefit from the principles of the present invention. In an embodiment, the bags of pressurized gas come in different pressures depending on the application. To avoid any confusion on energy capability of the wrap, the gas bags are colored to indicate bag pressure. They can also vary in size depending on requirements. The bags come in strips and other usable form which can be cut into shapes that will fit into appropriate protectable areas. In the present apparatus, by utilizing pre-charged bags, the apparatus can interact more quickly than traditional systems, and distribute the impact over a larger surface area than traditional systems while still in a compact enough space to allow for the helmet sizing to stay streamlined.

When an object having weight is in motion it has energy. The amount of energy is proportional to the object's weight and speed. If the object is stopped suddenly, the force generated is impact force. As would be expected, the quicker the stop, the larger the impact force. To control this impact force on a football helmet as an example, means in effect to cushion decelerate the force to a much lower speed and protect the wearer of the helmet. The amount of force needed to decelerate is a function of the controlled distance available for deceleration. As a result, the stopping or impact force must start to take effect immediately at impact and then absorb and distribute the remaining force energy over a short distance. This short distance is critical because it will assist in a streamlined and lightweight helmet design and its related advantages. The diameter of the helmet's outer shell should be kept to a minimum.

The pressurized bags of the present invention with the correct pre-charge pressure in the bags will generate the energy to gently decelerate the impact force in a predictable manner. This all starts with a pre-charge force deflection capability of the bags and then how they will increase in pressure and deflect and distribute the force as they are applied by the impact. The size of the anticipated impact force will determine the pressure and the number of bags required.

A key design feature is the pre-charge bag pressure which absorbs the initial force, compresses and then distributes the force to other until the impact force is well distributed and neutralized. If the pre-charge pressure is higher than need be, then the system will not deflect enough to distribute as much force to the other bags and the wearer impact will be higher. Having the bags deflect the maximum possible will provide the optimum performance with the load distributing to as many bags as possible. A main advantage of this method with the pre-charge is its predictability, its reaction time relative to impact, and its distribution efficiency at impact unlike that seen in the prior art. No prior art device provides the novel features and advantages of the present apparatus, which are:

Efficiency of impact absorption
Consistency of impact absorption
Efficiency of impact distribution
Predictability of impact distribution
Compact design In accordance with an embodiment, apparatus for protecting the head of a person from an externally applied force includes an inner shell which fits over the head of the person. An outer shell which fits over the inner shell. A plurality of bags which contain a pressurized gas are disposed between the inner shell and the outer shell. When an external force is applied to the outer shell certain of the bags distribute and partially absorb the external force.

In accordance with another embodiment, the pressurized gas is nitrogen.

In accordance with another embodiment, the plurality of bags include a plurality of strips of spaced apart bags.

In accordance with another embodiment, the inner shell includes a plurality of curved grooves, each of which is shaped and dimensioned to receive a strip of spaced apart bags.

In accordance with another embodiment, the plurality of bags include bags of different pressures.

In accordance with another embodiment, the plurality of bags include bags of different sizes.

In accordance with another embodiment, the plurality of bags including a sheet of bags.

In accordance with another embodiment, a plurality of anchors are connected to the inner shell, the anchors for securing the bags to the inner shell.

In accordance with another embodiment, the outer shell is connected to the inner shell by a pivot which moves within a slot.

In accordance with another embodiment, the inner shell has a front section, and the outer shell has a front section. The pivot is disposed at the front section of the outer shell, and the slot is disposed at the front section of the inner shell.

In accordance with another embodiment, a torsion absorbing device is connected between the front section of the outer shell and the front section of the inner shell.

In accordance with another embodiment, the torsion absorbing device includes a Belleville washer.

In accordance with another embodiment, the inner shell has left and right neck sections, and the outer shell has left and right neck sections. A left outer shell positioning device is connected between the left neck section of the inner shell and the left neck section of the outer shell, and a right outer shell positioning device is connected between the right neck section of the inner shell and the right neck section of the outer shell. The left and right outer shell positioning devices are used to adjust a neck section distance between the inner shell and the outer shell.

In accordance with another embodiment, the left and right outer shell positioning devices each include a turnbuckle.

Other embodiments, in addition to the embodiments enumerated above, will become apparent from the following detailed description, taken in conjunction with the accompanying drawings, which illustrate, by way of example, the principles of the apparatus.

BRIEF DESCRIPTION OF THE DRAWINGS

FIG. 1 is a perspective view of apparatus for protecting the head of a person;

FIG. 2 is a front elevation view of the apparatus;

FIG. 10 is a top plan view of a sheet of bags with mounting holes;

FIG. 11 is a top plan view of a strip of bags which include bags of different sizes and spacing.

FIG. 12 is a side elevation view of the strip of bags of FIG. 11;

FIG. 13 is a cutaway side elevation view of the apparatus;

FIG. 14 an enlarged cross sectional view of line 14-14 of FIG. 13;

FIG. 15 is a side elevation view of the apparatus with an outer shell rotated away from an inner shell;

FIG. 16 is an enlarged cross sectional view along the line 16-16 of FIG. 15;

DETAILED DESCRIPTION OF THE INVENTION

Figure 3:
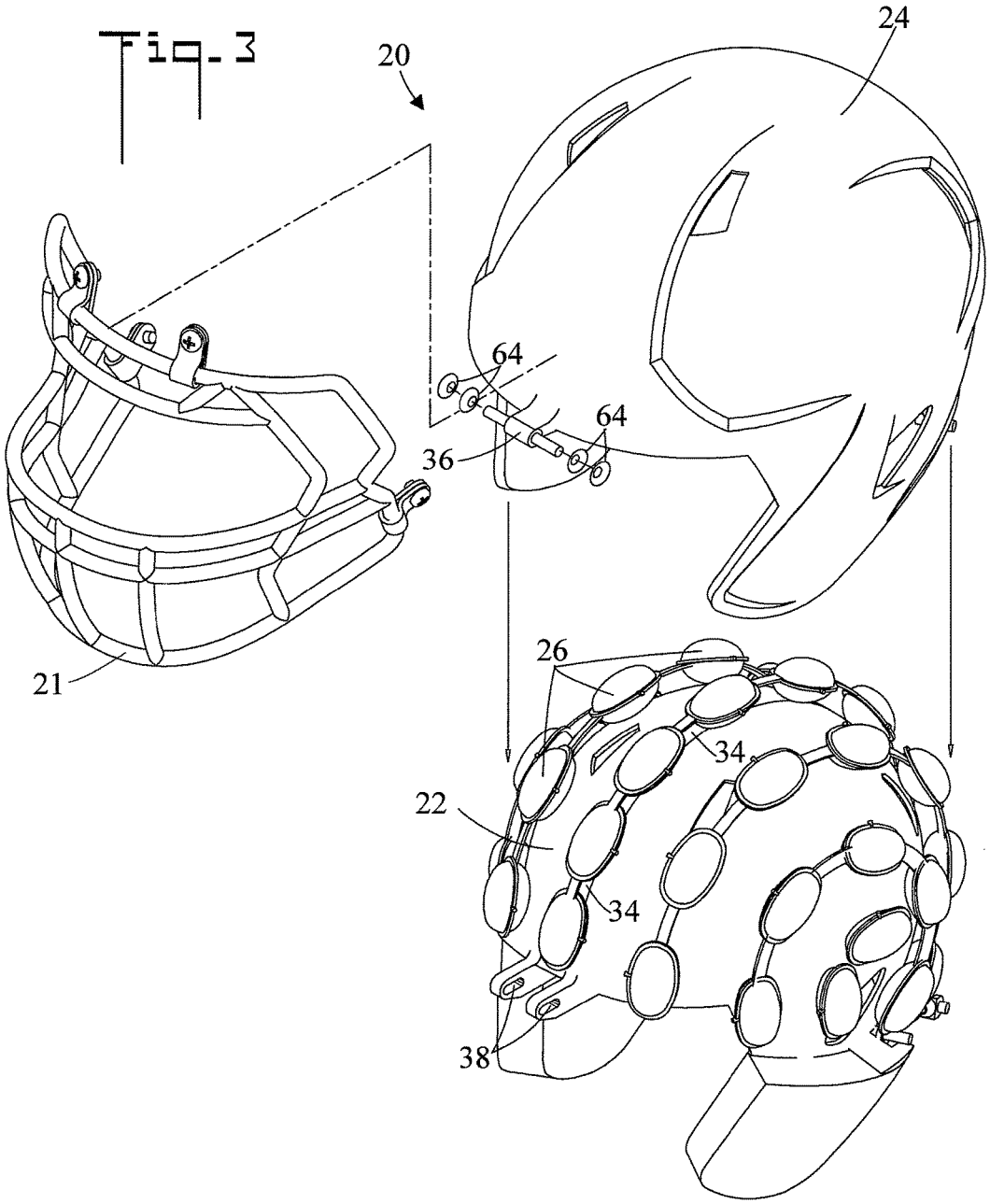
FIG. 3 is an exploded perspective view of the apparatus.
Figure 4:
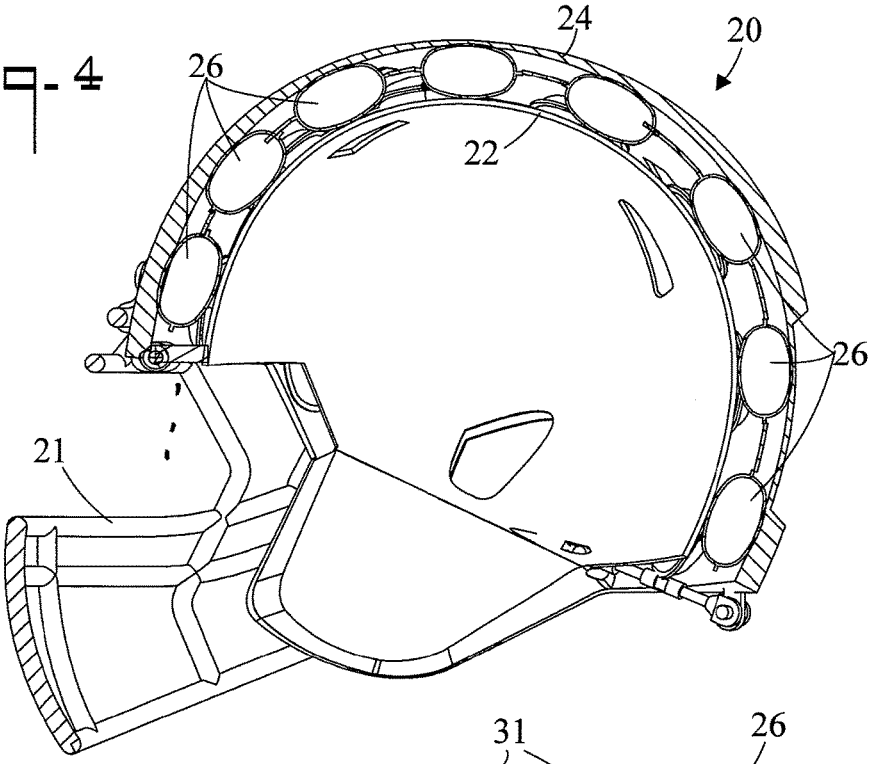
FIG. 4 is a cross sectional view along the line 4-4 of FIG. 2.

FIGS. 1-3 are perspective, front elevation, and exploded perspective views respectively of apparatus for protecting the head of a person from an external force, the apparatus generally designated as 20, and FIG. 4 is a cross sectional view along the line 4-4 of FIG. 2. In the shown embodiment apparatus 20 is a football helmet having a face guard 21, however it may be appreciated that the principles of the present invention can also be applied to other types of headgear. Apparatus 20 includes an inner shell 22 which fits over the head 500 of the person (wearer) (refer to FIG. 13). An outer shell 24 fits over inner shell 22. A plurality of bags 26 which contain a pressurized gas 28 are disposed between inner shell 22 and outer shell 24. As used herein the term "pressurized" means at a pressure above ambient atmospheric pressure. When an external force F (refer to FIGS. 20 and 21) is applied to outer shell 24 certain (some of the) bags 26 distribute and partially absorb the external force F. That is, the bags 26 which are disposed adjacent to the external force F are compressed and absorb energy from the force, while bags 26 which are disposed on the opposite side from the external force F are not compressed. It is noted that outer shell 24 is larger than inner shell 22 so there is a space therebetween to accommodate plurality of bags 26. In an embodiment, inner shell 22 and outer shell 24 are fabricated from a rigid polymer such as that used in existing football helmets. It is further appreciated that in the shown embodiment apparatus 20 is bilaterally symmetrical when viewed from the front as in FIG. 2

Figure 5:
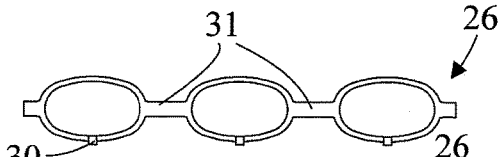
FIG. 5 is a top plan view of plurality of bags which contain a pressurized gas.
Figure 6:
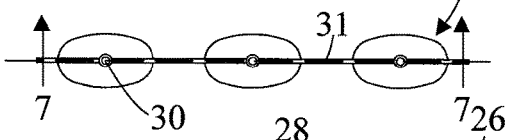
FIG. 6 is a side elevation view of a strip of bags.
Figure 7:
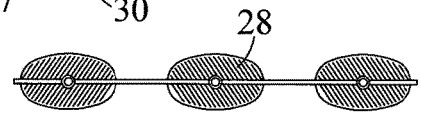
FIG. 7 is a cross sectional view along the line 7-7 of FIG. 6.

FIGS. 5-7 are top plan, side elevation, and cross sectional views respectively of the plurality of bags 26 each of which contains a pressurized gas 28. In an embodiment, the plurality of bags 26 are arranged in a strip of spaced apart bags 26, but can also be arranged in sheets of bags 26 (refer to FIG. 10), or can be separate individual bags 26. A flat flexible connector material 31 such as a flexible polymer connects bags 26 to form the strips. It is noted that the strips of bags 26 can be of different lengths, the strips and sheets can contain various numbers of bags 26, different size bags 26, bags 26 of different pressures, different bag 26 spacing, etc., as is necessary to provide proper cushioning (refer to FIG. 3). In an embodiment, pressurized gas 28 is nitrogen. Nitrogen is an inert gas which is predictable, non-flammable, will not support combustion, and does not contain moisture. As broadly defined herein "inert gas" means a gas such as nitrogen which has little or no ability to react in the atmosphere. It is noted that the number of bags 26 can vary depending on the size of apparatus 20. Bags 26 are placed so that they generally surround inner shell 22, and as such can cushion an external force F applied from any direction. In terms of placement, bags 26 are positioned to obtain maximum cushioning effect.

In an embodiment, the strips or sheets of bags 26 can be provided having different pressures. For example one strip could contain bags 26 all having a pressure of P1, another strip could contain bags 26 all having a different pressure P2, etc., depending upon the particular application. To avoid any confusion on energy absorption capability, the bags 26 can be color coded to indicate the bag pressure. Having bags 26 of different pressures can be useful if an anticipated external force F which comes from one direction is generally greater than a force coming from another direction. Each bag 26 contains a check valve 30 for charging the bag with pressurized gas. In various embodiments, the pressure within each bag 26 can be from 5 psi to 40 psi depending upon the particular application. Generally speaking, the higher the anticipated external force F, the higher the pressure should be in bags 26. In an embodiment, bags 26 are fabricated from epichlorohydric rubber (ECO) or acyrlonitrile (NBR).

Figure 8:
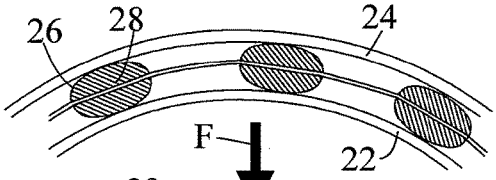
FIG. 8 is a cross sectional view showing bags in an uncompressed state.
Figure 9:
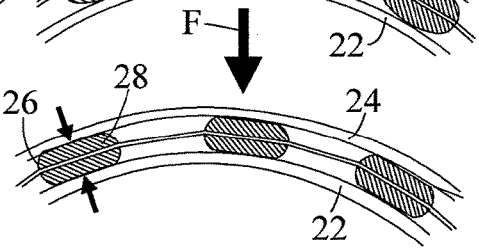
FIG. 9 is a cross sectional view showing bags in a compressed state.

FIG. 8 is a cross sectional view showing bags 26 in an uncompressed state, and FIG. 9 is a cross sectional view showing bags 26 in a compressed state. In FIG. 8 bags 26 are disposed between inner shell 22 and outer shell 24. In FIG. 9 when an external force F is applied to outer shell 24 (such as from a collision with another person, with an object, or with the ground) bags 26 compress wherein the pressure within the compressed bags 26 increases and the volume of the bags 26 decreases in accordance with Boyle's Law. Because the distance between inner shell 22 and outer shell 24 decreases, bags 26 are compressed (flattened). The compression process absorbs (cushions) some of the external force F. Moreover, the external force F is distributed over multiple compressing bags 26. The compression and distribution of external force F results in a lesser force being delivered to the head of the person wearing apparatus 20. As such the person is less likely to be injured by the force. The compression of bags 26 operates similar to a spring, wherein after compression bags 26 return to their original volume and pressure.

FIG. 10 is a top plan view of a sheet of bags 26 with mounting holes 32 for connection to inner shell 22 (refer to FIG. 3). Mounting holes 32 would receive mounting structure on inner shell 22 (not shown). It may be appreciated that the sheet of bags 26 can be larger or smaller and can contain different numbers of bags 26. The sheets can be cut into shapes which will fit the shape and contour of inner shell 22.

FIGS. 11 and 12 are top plan and side elevation views of a strip of bags 26 which includes bags 26 of different sizes and spacing. In the shown embodiment the strip contains bags 26 of two different sizes, of three different pressures P1, P2, and P3, and a spacing gap between two of the bags.

FIG. 13 is a cutaway side elevation view of apparatus 20, and FIG. 14 an enlarged cross sectional view along line 14-14 of FIG. 13. Also referring to FIG. 3, in an embodiment inner shell 22 includes a plurality of curved grooves 34, each of which is shaped and dimensioned to receive a strip of spaced apart bags 26. The bags 26 partially fit into grooves 34 which seat, hold in place on inner shell 22, and stabilize bags 26. In other words, inner shell 22 is fabricated from a rigid material which has a surface, the surface includes a plurality of curved grooves 34 which form hollows in the surface. Each curved groove 34 is configured so that a strip of spaced apart bags 26 partially fits (in depth) into curved groove 34 and is held in place. In the shown embodiment grooves 34 are generally semicircular in shape, are shaped and dimensioned to receive bags 26, are of different sizes, and are spaced transversely around inner shell 22. It is noted in FIG. 13 that bags 26 are shown in cross section, and that face guard 21 has been removed.

FIG. 15 is a side elevation view of apparatus 20 with outer shell 24 rotated away from an inner shell 22, and FIG. 16 is an enlarged cross sectional view along the line 16-16 of FIG. 15. The rotated position allows for access to inner shell 22 and bags 26. The rotation is effected by a two pronged pivot 36 which is disposed at the front section of outer shell 22 near the forehead of the wearer (refer to FIG. 3). Pivot 36 engages and rotates within two slots 38 disposed at the front section of inner shell 22 (refer to FIG. 3). It may be appreciated that inner shell 22 has a second slot 38 on the opposite (right as shown) side of inner shell 22 which would be seen if the front of apparatus 20 were to point to the right (refer to FIG. 3). The rotated position of FIG. 15 is permitted by disconnecting outer shell positioning devices 40 and 41 (turnbuckles in the shown embodiment) which connect the neck section of inner shell 22 (the portion of inner shell adjacent the neck of the wearer) to the neck section of outer shell 24 in the in-use position of apparatus 20 (refer to FIGS. 17 and 18).

FIGS. 15 and 16 also show a plurality of anchors 42 which are fixedly connected to inner shell 22. Anchors 42 are utilized to securely connect the strips of bags 26 to inner shell 22, and to permit easy and rapid bag 26 installation and replacement. The number of anchors 42 can vary depending upon the particular application. In an embodiment, anchors 42 are flexible and can be opened and closed in the direction of the arrows to receive and lock the strip of bags 26 in place. One end of anchor 42 is connected to inner shell 22 using a hoop and loop fastener 44. Anchors 42 engage connector material 31.

Figure 17:
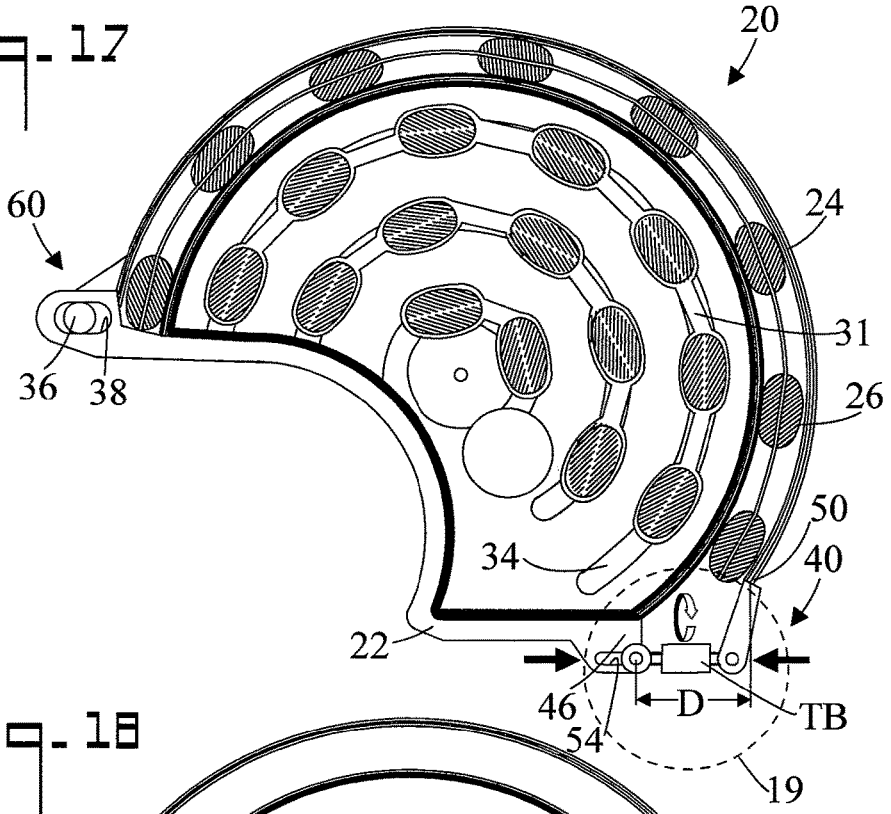
FIG. 17 is a cutaway side elevation view of the apparatus showing an outer shell positioning device.
Figure 18:
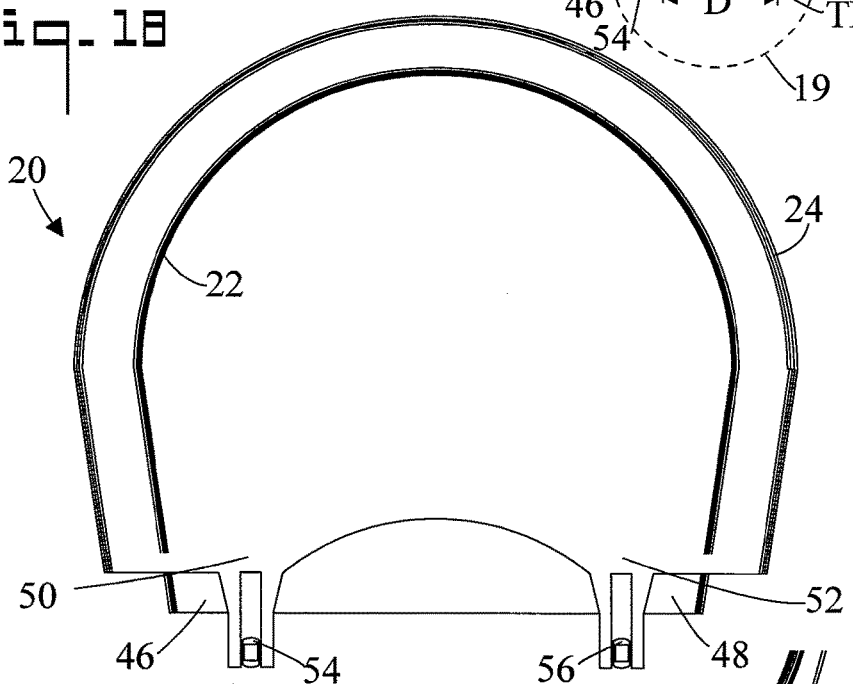
FIG. 18 is a rear elevation view showing the outer shell positioning device.
Figure 19:
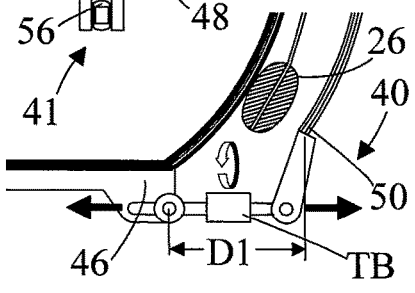
FIG. 19 is an enlarged view of area 19 of FIG. 17 with the outer shell in a different position.

FIG. 17 is a cutaway side elevation view of apparatus 20 showing an outer shell positioning device 40, FIG. 18 is a rear elevation view showing the outer shell positioning device 40, and FIG. 19 is an enlarged view of area 19 of FIG. 17 with the outer shell 24 in a different position. Inner shell 22 has a left neck section 46 and an opposite right neck section 48. Outer shell 24 has a left neck section 50 and an opposite right neck section 52. The neck sections are disposed adjacent the rear part of the neck of the wearer. A left outer shell positioning device 40 is connected between left neck section 46 of inner shell 22 and left neck section 50 of outer shell 24. Similarly, a right outer shell positioning device 41 is connected between right neck section 48 of inner shell 22 and right neck section 52 of outer shell 24. Left 40 and right 41 outer shell positioning devices are used to adjust a neck section distance between inner shell 22 and outer shell 24. In the shown embodiment, left 40 and right 41 outer shell positioning devices each including a turnbuckle TB. Left 40 and right 41 outer shell positioning devices are utilized to set an initial compression on bags 26 by moving outer shell 24 toward inner shell 22 as shown in FIG. 17. Left 40 and right 41 outer shell positioning devices also serve to seat bags 26 in grooves 34 in inner shell. Slots 54 and 56 on inner shell 22 accommodate movement of the turnbuckle TB, particularly when apparatus 20 is exposed to an external force from the rear (refer to FIG. 21 and the associated discussion). It is noted that in FIG. 17 left outer shell positioning device 40 has been adjusted so that a neck section distance D exists between outer shell 24 and inner shell 22. In the shown embodiment the turnbuckle TB moves outer shell 24 and inner shell 22 together in the direction of the arrows. In this position bags 26 are slightly compressed and seated in inner shell grooves 34. Conversely, in FIG. 19 left outer shell positioning device 40 is adjusted so that a greater neck section distance D1 exists between outer shell 24 and inner shell 22. It may be appreciated that the operation of right outer shell positioning device 41 is the same as described above. In FIG. 17 it is noted that apparatus 20 is designed so that when it is not being impacted by an external force F, pivot 36 resides approximately in the center of slots 38. By placing pivot 36 in the center of slot 28, apparatus 20 can accommodate external forces applied to both the front and rear (refer to FIGS. 20 and 21). When impacted, pivot 36 will move within slots 38 as the force is being absorbed by bags 26.

Figure 20:
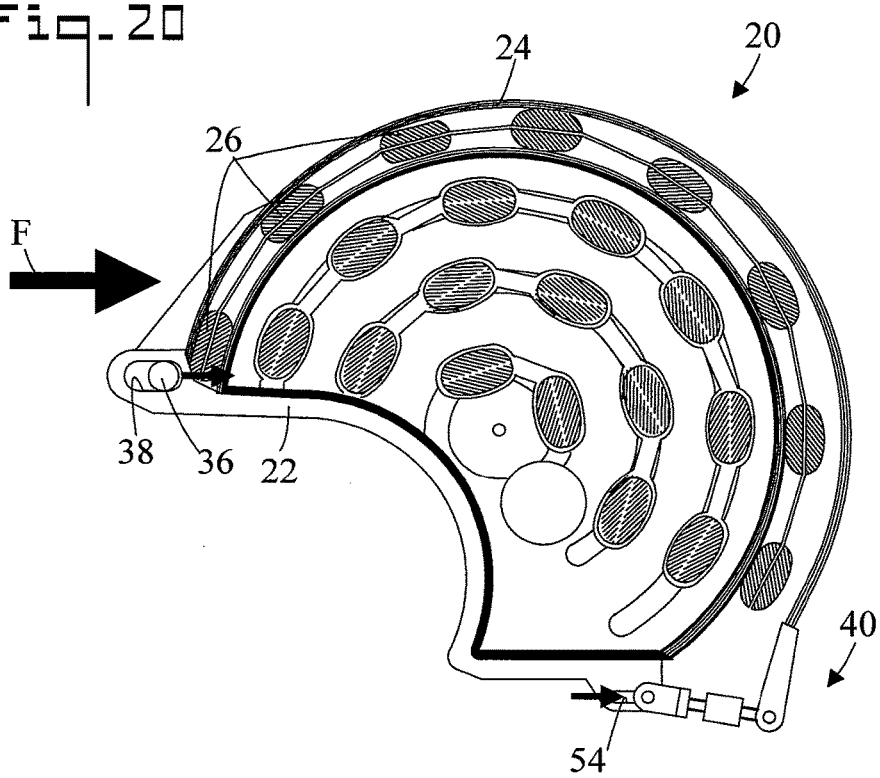
FIG. 20 is a cutaway side elevation view showing an external force applied to the front of the apparatus.

FIG. 20 is a cutaway side elevation view showing an external force F applied to the front of apparatus 20. Such a force could be encountered due to a collision with another person, with an object, or with the ground. External force F causes outer shell 24 to move with respect to inner shell 22 (to the right as shown). As such, pivot 36 moves within slot 38 of inner shell 22 in the direction of the arrow. The energy of force F is partially absorbed and distributed by the bags 26 which are located on the front side of apparatus 20. The closer a bag 26 is to the point of impact, the more it will compress. This compression cushions and reduces the force which is received by the head of the person 500 (refer to FIG. 13), and reduces the chance of injury. Also, it is noted in FIG. 20 that left 40 and right 41 outer shell positioning device move in slots 54.

Figure 21:
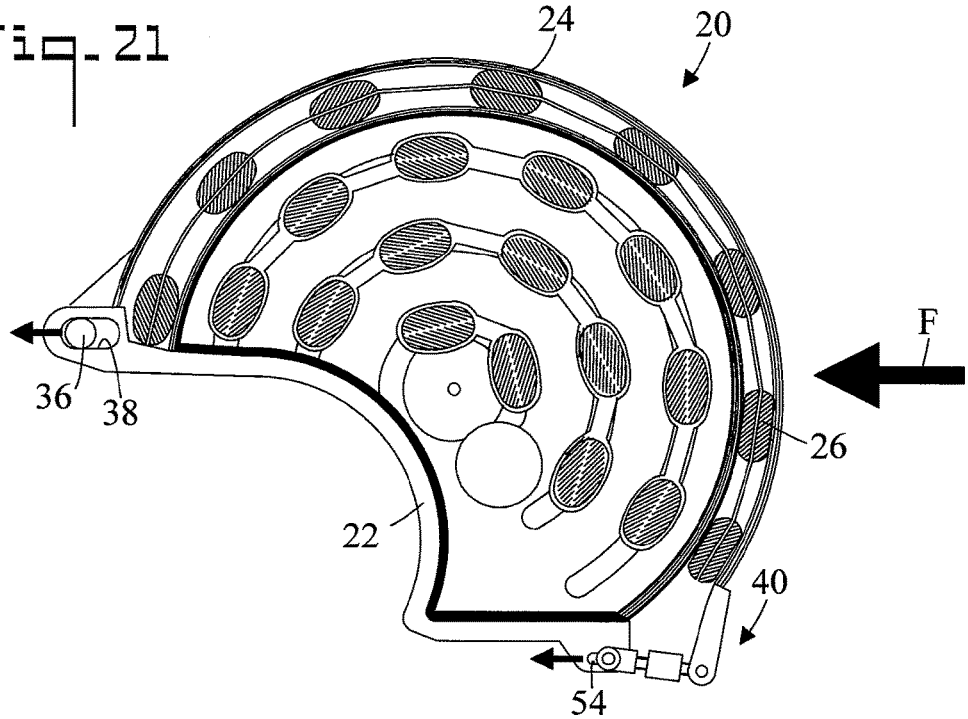
FIG. 21 is a cutaway side elevation view showing an external force applied to the rear of the apparatus.

FIG. 21 is a cutaway side elevation view showing an external force F applied to the rear of apparatus 20. External force F causes outer shell 24 to move with respect to inner shell 22 (to the left as shown). As such, left 40 and right 41 outer shell positioning devices move within slots 54 and 56 in the direction of the arrow. The energy of force F is partially absorbed and distributed by the bags 26 which are located on the rear side of apparatus 20. It is noted that for both the front impact of FIG. 20 and the rear impact of FIG. 21 outer shell 24 rotates slightly about pivot 36 (clockwise as shown). It may be appreciated that a similar cushioning effect exists when an external force F is applied to the sides or top of apparatus 20. Also it is noted in FIG. 21 that pivot 36 moves in slot 38.

Figure 23:
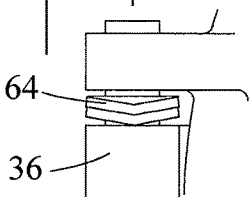
FIG. 23 is an enlarged view of area 23 of FIG. 22 with the torsion absorbing device unloaded.
Figure 22:
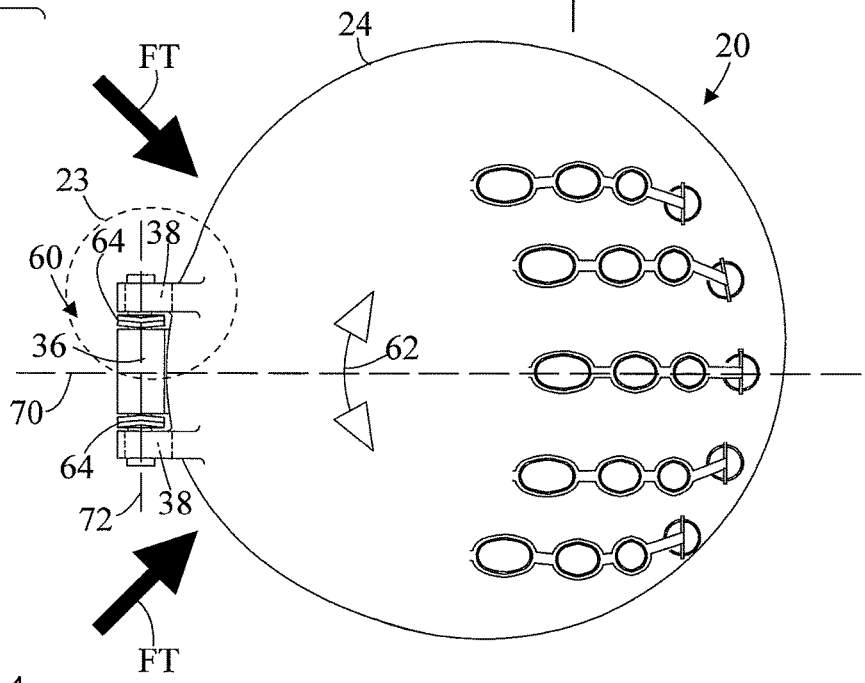
FIG. 22 is a cutaway top plan view showing a torsion absorbing device.
Figure 24:
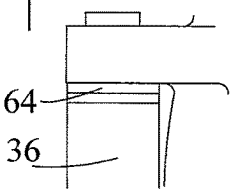
FIG. 24 is an enlarged view as in FIG. 23 with the torsion absorbing device loaded from a torsion force; and, FIG. 25 is an enlarged cross sectional view along the line 25-25 of FIG. 2

FIG. 22 is a cutaway top plan view showing a torsion absorbing device 60. FIG. 23 is an enlarged view of area 23 of FIG. 22 with torsion absorbing device 60 unloaded, and FIG. 24 is an enlarged view as in FIG. 23 with the torsion absorbing device 60 loaded from a torsion force FT. The torsion force FT is applied between the front and side of apparatus 20 and causes outer shell 24 to rotate as indicated by arrows 62. Outer shell 24 and inner shell 22 each have a front section (adjacent the forehead of the wearer). Torsion absorbing device 60 is connected between the front section of outer shell 24 and front section of inner shell 22 (also refer to FIG. 17), and absorbs torsion forces. It may be appreciated that the opposite (right) side view of torsion absorbing device 60 is the mirror image. Torsion absorbing device 60 includes a Belleville washer 64. In the shown embodiment, four Bellville washers are utilized, two engaging each side of pivot 36. The Belleville washers 64 are conical in shape and will behave similar to a compression spring. They will compress as load increases until flat and then return to original shape with the load is removed. The main benefit of Belleville washer 64 is that they, in addition to bags 26, will absorb torsional energy. In FIG. 23 Belleville washers 64 (two in number) are relaxed. In FIG. 24 a torsion force FT has been applied to apparatus 20 causing Belleville washers 64 to compress and in so doing partially absorb torsion force FT. Also referring to FIGS. 3 and 15, it is noted that inner shell inner shell 22 has a front section and an opposite rear section with a central axis 70 disposed therebetween. Two slots 38 are disposed at the front section of inner shell 22. Pivot 36 has a pivot axis 72 which is disposed perpendicular to central axis 70 of inner shell 22. Pivot 36 has two outwardly projecting prongs one of which is received by one of the two slots 38 and the other of which is received by the other of the two slots 38. Torsion absorbing device 60 includes Belleville washers 64 which are positioned around the two outwardly projecting prongs of pivot 36.

Figure 25:
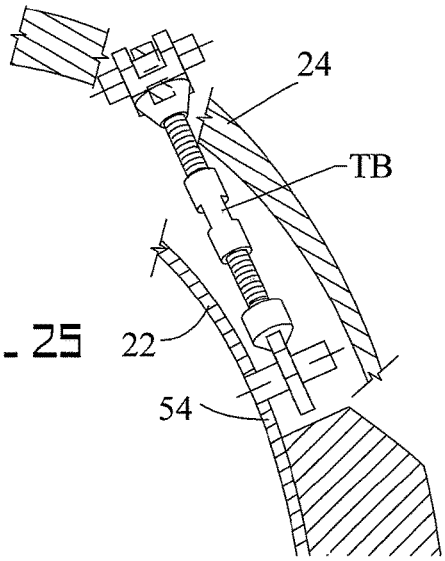

FIG. 25 is an enlarged cross sectional view along the line 25-25 of FIG. 2 showing another view of torsion absorbing device 60. Shown are inner shell 22, outer shell 24, and turnbuckle TB.

The embodiments of the apparatus described herein are exemplary and numerous modifications, combinations, variations, and rearrangements can be readily envisioned to achieve an equivalent result, all of which are intended to be embraced within the scope of the appended claims. Further, nothing in the above-provided discussions of the apparatus should be construed as limiting the invention to a particular embodiment or combination of embodiments. The scope of the invention is defined by the appended claims.

We claim:

1. An apparatus for protecting the head of a person from an external force, comprising:

an inner shell which is configured to fit over the head of the person;

an outer shell which fits over said inner shell;

a plurality of bags which contain a pressurized gas disposed between said inner shell and said outer shell;

said plurality of bags including a plurality of strips of spaced apart bags;

wherein said inner shell is fabricated from a rigid material which has a surface, said surface including a plurality of curved grooves which form hollows in said surface, and each said curved groove is configured so that a said strip of spaced apart bags partially fits into said curved groove and is held in place;

wherein said outer shell is connected to said inner shell by a pivot which moves within two slots;

said inner shell having a front section and an opposite rear section with a central axis disposed therebetween, and said two slots are disposed at said front section of said inner shell;

said outer shell having a front section, and said pivot is disposed at said front section of said outer shell;

said pivot having a pivot axis which is disposed perpendicular to said central axis of said inner shell, and said pivot having two outwardly projecting prongs, one of which is received by one of said two slots and the other of which is received by the other of said two slots.

2. The apparatus according to claim 1, further including:

a plurality of anchors connected to said inner shell, said anchors configured to secure said strips of bags to said inner shell, wherein said anchors are configured to open to receive said strips of bags and are configured to close to hold said strips of bags.

3. The apparatus according to claim 1, further including:

a torsion absorbing device connected between said front section of said outer shell and said front section of said inner shell;

said torsion absorbing device including Belleville washers which are positioned around said two outwardly projecting prongs of said pivot.

* * * * *